US008277584B2

(12) United States Patent
Cohen-Arazi et al.

(10) Patent No.: US 8,277,584 B2
(45) Date of Patent: Oct. 2, 2012

(54) EXTREMELY INSENSITIVE DETONATING SUBSTANCE AND METHOD FOR ITS MANUFACTURE

(75) Inventors: Yael Cohen-Arazi, Kfar Vradim (IL); Edith Sokol, Naharia (IL); Samuel Friling, Kfar Vradim (IL); Ilan Shaked, Nahariya (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 360 days.

(21) Appl. No.: 11/918,258

(22) PCT Filed: Apr. 11, 2006

(86) PCT No.: PCT/IL2006/000457

§ 371 (c)(1),
(2), (4) Date: Nov. 15, 2007

(87) PCT Pub. No.: WO2006/109304

PCT Pub. Date: Oct. 19, 2006

(65) Prior Publication Data

US 2009/0078346 A1 Mar. 26, 2009

(30) Foreign Application Priority Data

Apr. 12, 2005 (IL) ..... 167985

(51) Int. Cl.
*C06B 25/00* (2006.01)
*C06B 25/34* (2006.01)
*D03D 23/00* (2006.01)
*D03D 43/00* (2006.01)

(52) U.S. Cl. ..... 149/92; 149/88; 149/108.8; 149/109.4

(58) Field of Classification Search ..... 149/92, 149/88, 108.8, 109.4
See application file for complete search history.

(56) References Cited

U.S. PATENT DOCUMENTS

| | | | | | |
|---|---|---|---|---|---|
| 3,338,764 | A | * | 8/1967 | Evans | 149/19.4 |
| 3,725,154 | A | | 4/1973 | McCulloch et al. | |
| 3,956,038 | A | * | 5/1976 | Duguet et al. | 149/4 |
| 4,861,397 | A | * | 8/1989 | Hillstrom | 149/19.4 |
| 4,963,291 | A | * | 10/1990 | Bercaw | 252/512 |
| 5,080,735 | A | * | 1/1992 | Wagner | 149/19.3 |
| 5,417,161 | A | | 5/1995 | Sanai et al. | |
| 6,039,819 | A | * | 3/2000 | Harrod et al. | 149/19.2 |

FOREIGN PATENT DOCUMENTS

| | | | | |
|---|---|---|---|---|
| DE | 28 31 415 | C1 | | 7/1996 |
| EP | 0 625 495 | A1 | | 11/1994 |
| JP | 2-293388 | A | | 12/1990 |
| WO | WO 98/46544 | | * | 10/1998 |
| WO | 2004/039752 | A1 | | 5/2004 |

* cited by examiner

*Primary Examiner* — James McDonough
(74) *Attorney, Agent, or Firm* — Vorys, Sater, Seymour and Pease LLP; Susanne M. Hopkins; William L. Klima

(57) ABSTRACT

The present invention provides an explosive composition of substantially reduced sensitivity and low flammability, being definable as an extremely insensitive detonating substance (EIDS) according to UN Regulations for the Transport of Dangerous Goods and comprising one or more explosive material 42-58% vol., one or more fire retardant material 15-26% vol. and a binder 20-36% vol.

32 Claims, 4 Drawing Sheets

EXTREMELY INSENSITIVE DETONATING SUBSTANCE AND METHOD FOR ITS MANUFACTURE

FIELD OF THE INVENTION

The present invention relates to an explosive composition of substantially reduced sensitivity and low flammability and a method for its manufacture. More specifically, the present invention is concerned with an explosive composition definable as an extremely insensitive detonating substance (EIDS) according to UN Regulations for the Transport of Dangerous Goods (often referred to as the 'orange book'), classified in Class 1.5D.

BACKGROUND OF THE INVENTION

High performance explosive compositions are long known. It has been a goal for researchers to find new explosive compositions which can be defined as low impact and shock sensitivity and low flammability, nevertheless offer high energy explosive performance. A combination of these properties offers higher survivability when applied in armor modules as well as greater transportation and handling safety, whilst not deteriorating the overall performance, when compared to readily available explosive compositions of similar energetic properties.

One example of low-flammability explosive compositions is disclosed in U.S. Pat. No. 4,861,397 to Hillstrom disclosing a material comprising an explosive in an amount of 41-85%, an additive selected from the group consisting of zinc borate, hexabromobiphenyl molybdenum flame suppressant, triaryl phosphate ester, calcium formate, antimony oxide, ammonium phosphate, aluminum oxide trihydrate, and organophosphorous diols in an amount of 9-41% and a binder component selected from the group consisting of polyurethane, acrylic polymers, phosphate ester-vinyl chloride latexes, cellulose acetate butyrate, vinyl esters, styrene-ethylene butylene block copolymers fluorinated elastomers, and Plaster of Paris rubberized with acrylic latexes in an amount of 6-39%, all of proportions being on a % by weight basis.

U.S. Pat. No. 5,080,735 to Wagner discloses a cap-sensitive flexible explosive composition of reduced flammability comprising a finely divided cap-sensitive explosive in a flame resistant polymeric binder system which comprises a fluorinated elastomer, or mixture of fluorinated elastomers, admixed with from about 10% to about 30% by weight of a compatible flame retardant material, a drip suppressant, and optionally a cross-linking activator whereby the binder system when exposed to heat from an ignition source will crosslink and harden at a rate which is faster than the rate at which the explosive composition will burn. This material is commercially available and is known as LF-2.

The composition disclosed in the '735 patent is concerned, as stated above, with a cap-sensitive composition. The term 'cap-sensitive' composition denotes a substance detonable when subjected to ignition by a so-called No. 8 detonator at unconfined substance conditions, i.e. a substance classified in Class 1.1D according to UN Regulations for the Transport of Dangerous Goods.

The explosive composition, provided between plates of a cassette of a reactive armor module, causes the plates to displace as result of detonation, and thus scatter (break) the jet caused by a warhead hitting the reactive armor module. Some major problems associated with reactive armors arise from the use of excessively sensitive and flammable explosive compositions. Excessive flammability can lead to ignition of the explosive even by small or medium caliber threats. In case the explosive composition burns, a potentially dangerous result may ensue e.g. for a vehicle's crew, because burning of the confined explosive composition may cause detonation, creating some serious hazards for personnel in the vicinity of the vehicle. Moreover, burning increases both the visual and thermal signature of the protected vehicle and further, the fire is likely to consume the entire explosive in the particular armor tile and may even spread to adjacent tiles. Obviously, a reactive armor tile in which the explosive composition has burnt, offers no protection against shaped charge threats.

Other explosive compositions are not fully satisfactory and are either too impact sensitive or shock sensitive and thus may burn and/or detonate at some undesired conditions and further may have unsatisfactory physical or mechanical properties, or suffer from difficulties and limitations in their preparation and application.

It is thus the purpose of the present invention to provide an explosive composition of substantially reduced impact/shock sensitivity and low flammability, which composition is classified in Class 1.5D according to UN regulation, i.e. a composition definable as an extremely insensitive detonating substance (EIDS), and the preparation of which is substantially simple.

SUMMARY OF THE INVENTION

According to the present invention there is provided an explosive composition having significantly low sensitivity, low flammability and a high self-extinguishing rate, such that it is detonable only under extremely high pressure/energy conditions, e.g. striking of a jet warhead, and offers high performance as compared to readily available explosive compositions of similar energetic properties. The present invention is also concerned with a method for manufacturing such an explosive composition and applications for use of said composition.

The composition according to the present invention is of substantially low flammability, i.e. it is not easily ignitable by conventional means (such as black powder, small arms, projectiles, shrapnel, etc.), however once ignited its burning rate is significantly low (almost as a passive material) and its self extinguishing rate is significantly high. In any event, the probability of burning-to-detonation-transition is negligible.

The composition according to the present invention is of substantially low sensitivity, i.e. complies with test series 3, 5, and 6 according to the UN regulations. For example, the composition according to the present invention is not cap-sensitive (test 5(*a*)) even under confined conditions, non-ignitable in deflagration-to-detonation-transition (DDT) test (test 5(*b*)) and reacts as a passive material in external fire test (test 6(*c*)).

In light of the above, the composition according to the present invention is classified in Class 1.5D (EIDS) according to UN regulation.

According to the present invention the explosive composition comprises one or more explosive materials, one or more fire retardant materials and a binder and optionally, some other additives for obtaining various desired properties.

In accordance with the present invention a volumetric percentage of the components in the explosive composition are in the following ranges, as follows:

| | |
|---|---|
| Explosive material/s | 42-58% vol. |
| Fire retardant/s | 15-26% vol |
| Binder | 20-36% vol |

The explosive material/s may be selected from a group comprising pentaerythritol tetranitrate (PETN), cyclotrimethylene trinitramine (RDX and reduced sensitivity RDX), cyclotetramethylene tetranitramine (HMX and reduced sensitivity HMX), trinitrotoluene (TNT), nitrotriazolone (NTO), CL-20, FOX-7 and any other such explosive, or mixtures thereof. The one or more raw explosive materials may be in several granulations chosen according to the desired final properties of the explosive composition.

The fire retardant may be selected from a group comprising boron containing compounds such as zinc borate, boric acid, ammonium fluoroborate etc.; phosphorus containing compounds such as phosphate esters, ammonium polyphosphate, etc.; halogen containing inorganic compounds or hydrocarbon compounds, such as decabromodiphenyl oxide (DBDPO), with or without radical stabilizers, such as antimony oxide; hydrated materials, such as alumina trihydrate (ATH), magnesium dehydrate, etc., and any other such fire retardants known in the art or mixtures thereof.

The binder may be a thermoplastic or thermosetic polymer. The binder may be selected from a group comprising thermoplastic polymers, such as Estane™, Kraton™, Fluorel™, Viton™ etc., or a group of thermosetic polymers, such as polyurethanes (e.g. HTPB, Desmophen™, etc.), polydimethylsiloxanes (PDMS), etc.

In compliance with US laws and regulations any plastic bonded explosive (PBX) must contain a taggent agent (for detection by security sniffers) and thus, the explosive composition according to the present invention may contain a taggent agent selected from a group comprising Ethylene glycol dinitrate (EGDN), 2,3-Dimethyl-2,3-dinitrobutane (DMDNB), para-Mononitrotoluene (p-MNT), and ortho-Mononitrotoluene (o-MNT), etc.

Optionally, coloring agents (pigments) may be added to the composition for differentiation purposes between different compositions. The pigment may be in powder or liquid form.

It is also possible to add to the compositions of the invention cross-linking inhibitors (or pot-life extenders), such as aliphatic phosphates. A suitable pot-life extender is, e.g. tris (2-ethylhexyl) phosphate (EHP).

Depending on the selection of the fire retardant materials, the composition according to the present invention produces burning and explosive products which are not more toxic than burning and explosion products of conventional explosives. For example, acidic gasses such as HCl or HBr are not emitted during burning or explosion of the explosive composition but rather, regular burning gasses are emitted such as NOx, carbon oxides, etc.

Furthermore, the raw materials used for preparation of the explosive composition are substantially non toxic, and in any case those materials which may be considered as hazardous, such as the cross-linking inhibitor and the catalyst, are at significantly low quantities in the composition.

An important feature of the explosive composition in accordance with the present invention is that quantitative reverse analysis for providing the exact content of the raw materials in the composition is practically not possible or substantially complicated.

The present invention is further concerned with a method for manufacturing of an explosive composition in accordance with the invention as will be disclosed hereinafter. It is appreciated that granulations and ratios of the powdered materials have significant influence on the mechanical properties of the final explosive composition, namely flexibility, strength, strain hardness, etc. The granulation ratio defines the compactability of the powdered components in the composition and thus reflects on the mechanical properties of the final product.

The explosive composition in accordance with the present invention is thus characterized by the following features:

- the composition offers similar explosive performance (efficiency) as of other known explosive compositions (e.g. for Explosive Reactive Armor (ERA))
- the explosive composition is classified in Class 1.5D according to UN Classification, i.e. the material is defined as an extremely insensitive detonating substance (EIDS);
- the burning time is shorter (i.e. the extinguishing rate is high) than heretofore known low flammability compositions;
- the composition is cheaper than heretofore similar compositions owing to the ingredients used and the method for its manufacture;
- the explosive composition in accordance with the present invention is easily machined (by hand or by machine) to cut, pierce, fold, etc., and is easily applied;
- the explosive composition in accordance with the present invention is substantially durable to environmental conditions such as temperature and humidity changes. It is water and other liquid substances resistant (e.g. oil, fuel, etc.), and retains its properties also after long periods of time at room temperature (above 10 years), and at 70° C. for at least three months;
- the explosive composition according to the present invention may be manufactured into flexible or rigid form, depending on the intended use and purpose.

BRIEF DESCRIPTION OF THE DRAWINGS

In order to better understand the invention, some non-limiting illustrations are provided herein, wherein:

FIGS. 3 to 5 are photographs of several safety test setups and their respective results, according to the UN regulations, wherein:

DETAILED DESCRIPTION OF THE INVENTION

Figure 1:
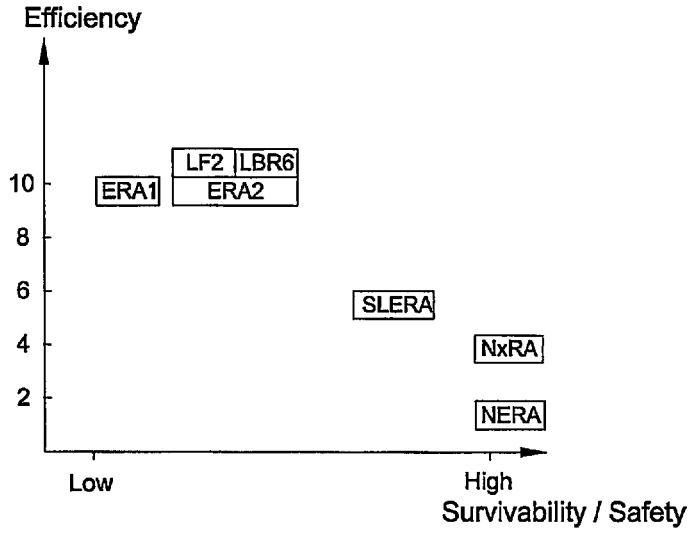
FIG. 1 is a schematic representation comparing efficiency versus survivability/safety of various energetic/explosive compositions.

The composition according to the present invention is of substantially low flammability, i.e. it is not easily ignitable by conventional means (such as small arms, projectiles, shrapnel, black powder, etc.), however once ignited its burning rate is significantly low (almost as a passive material) and in any case its self extinguishing rate is significantly high. In any event, the probability of burning-to-detonation-transition is negligible.

The following are examples of compositions of explosive compositions in accordance with the present invention, wherein percentages of ingredients are indicated in percent volume.

| | |
|---|---|
| Explosive material | 42-58% vol.; |
| Fire retardant | 15-26% vol.; |
| Binder | 20-36% vol. |

The explosive material may be a homogenous explosive material or may consist of two or more materials. For example, RDX and HMX in 10:1 ratio may be used.

The fire retardant may be selected from a group comprising of boron containing compounds such as zinc borate, boric acid, ammonium fluoroborate etc.; phosphorus containing compounds such as phosphate esters, ammonium polyphosphate, etc.; halogen containing inorganic compounds or hydrocarbon compounds, such as decabromodiphenyl oxide (DBDPO), with or without radical stabilizers, such as antimony oxide; hydrated materials, such as aluminum trihydrate (ATH), magnesium dehydrate, etc., and any other such fire retardants known in the art or mixtures thereof.

The binder may be a thermoplastic or thermosetic polymer. The binder may be selected from a group comprising of thermoplastic polymers, such as Estane™, Kraton™, Fluorel™, Viton™ etc., or a group of thermosetic polymers, such as polyurethanes (e.g. HTPB, Desmophen™, etc.), polydimethylsiloxanes (PDMS), etc. According to one particular embodiment, the binder comprises PDMS (between about 88-95% weight), a cross-linking agent (between about 5-10% weight) and a catalyst (between about 0.05-0.2% weight). The binder typically comprises a cross-linking inhibitor such as tris(2-ethylhexyl)phosphate (EHP) in a typical amount of 0.3-1.5% weight.

The taggent agent may be selected from a group comprising, among others, Ethylene glycol dinitrate (EGDN), 2,3-Dimethyl-2,3-dinitrobutane (DMDNB), para-Mononitrotoluene (p-MNT), and ortho-Mononitrotoluene (o-MNT), etc.

The method for manufacturing of an explosive composition in accordance with the present invention comprises the following steps:

a) drying powdered explosive materials in a specially designed explosive proof oven for explosive powders;
b) weighing raw materials;
c) mixing the raw materials, e.g. in a sigma mixer or a planetary mixer, as known per se, thereby obtaining a dough;
d) removal of residual air from the dough to thereby avoid presence of air voids in the final product. This is obtained under vacuum and the composition is then compressed through a nozzle having a desired shape, e.g. cord shaped, flat paste form, etc.;
e) cross-linking the composition in an oven at 50-70° C. to harden the composition. This stage, however, may be omitted to thereby retain the composition as a dough for different applications e.g. where the final product is to be injected in its use;
f) forming the hardened composition to a desired final shape.

It is appreciated that different levels of cross-linking may be performed in order to obtain different levels of flexibility of the final product. While cross-linking, the chemical, sensitivity and energetic properties of the composition are not affected, but rather only the mechanical properties of the resultant product.

It is further appreciated that the explosive composition obtained after the compressing stage through the shaped nozzle (step d) may be of any desired form. For example, for use in reactive armor modules, sheets of material are required. In this case, the paste obtained after step d) is pressed using spacers so as to obtain material at a desired and uniform thickness.

Furthermore, forming the final material, i.e. cutting and piercing of the final composition obtained at step e) may be carried out by mechanical means, e.g. using a water jet or different types of presses or rollers, or, alternatively, it may be carried out manually, using simple means such a scissors, knives, mold templates punches, etc.

When the composition is to be used as an exploding cord for example, to cut/sheer pillars, pipes, etc., the explosive composition is formed in the shape of a flexible cord.

The explosive composition according to the present invention may be modified, and the following are different examples:

EXAMPLE 2

| | |
|---|---|
| explosive material - RDX | 55% vol, |
| ATH | 20% vol, |
| PDMS | 25% vol, |
| pigment | 0.05% vol, |
| taggent (e.g. DMDNB) | 0.18% vol. |

EXAMPLE 3

| | |
|---|---|
| explosive material - RDX | 46% vol, |
| explosive material - HMX | 4% vol, |
| boric acid | 25% vol, |
| PDMS | 25% vol, |
| pigment | 0.05% vol, |
| taggent (e.g. DMDNB) | 0.2% vol. |

EXAMPLE 4

| | |
|---|---|
| explosive material - RDX | 48% vol, |
| explosive material - HMX | 6% vol, |
| boric acid | 22% vol, |
| PDMS | 24% vol, |
| pigment | 0.05% vol, |
| taggent (e.g. DMDNB) | 0.18% vol. |

The following table illustrates the differences between the compositions of the above examples, as reflected in ballistic (armor) and bullet impact sensitivity test results.

| | Example 2 | Example 3 | Example 4 |
|---|---|---|---|
| Performance/efficiency (armor) | +++ | ++ | +++ |
| bullet impact sensitivity | ++ | +++ | +++ |

It is further appreciated that the granulation ratios of the raw powdered materials, in particular the explosive materials and the solid fire retardants, influence only the mechanical properties of the resultant composition, namely, flexibility, strength, stain, hardness, etc.

Turning now to FIG. 1, there is illustrated a graph representing the efficiency (in an armor module) of different explosive compositions versus their survivability/safety. As may be noted the explosive composition in accordance with the present invention, identified as LBR-6, shows significantly high efficiency with reasonable survivability/safety as compared with other compositions for explosive reactive armor (ERA). The composition identified as LF-2, which is available in the market, shows similar survivability in an armor module as of the LBR-6 though its safety is lower than that of LBR-6: LF-2 is classified according to the aforementioned UN regulations under Class 1.1D, while LBR-6 is classified under Class 1.5D.

Self-Limiting ERA (SLERA) comprises an energetic material/explosive layer in armor module, which can provide good multiple-hit capability in modular configuration. The energetic material/explosive used in SLERA is not as effective as fully detonable explosives. This material can be classified under Class 1.5D or potentially be excluded from Class 1 (not an explosive).

Non-Explosive Reactive Armor (NxRA) has comparable efficiency to SLERA, though the energetic material in NxRA is not an explosive (not in Class 1). The survivability of NxRA is good, ant it has good multiple-hit capability against hollow charge warheads.

Non-Energetic Reactive Armor (NERA) has limited efficiency against hollow charges and is totally passive, thus provides excellent survivability and maximal multiple-hit capability. In this type of armor module, the material layer in the cassette is not energetic at all, e.g. rubber, glass, etc.

Figure 2:
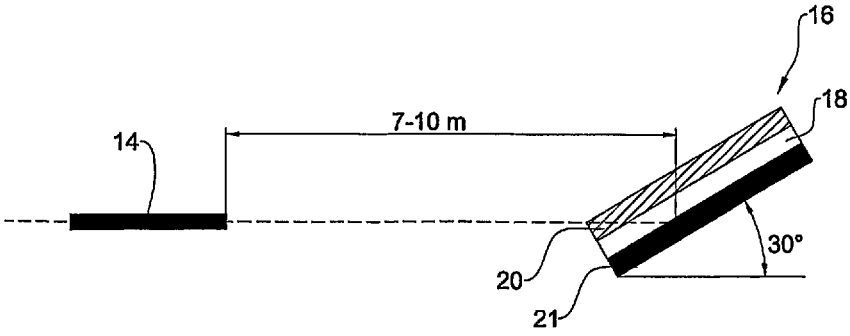
FIG. 2 is a schematic representation of a bullet impact sensitivity test setup.

Turning now to FIG. 2 there is a schematic representation of a bullet impact sensitivity test setup illustrating a barrel 14 aimed to fire rounds of 14.5 mm small arms at a sandwich-like element 16 containing an 8 mm thick layer of tested composition 18 (the energetic material or explosive) displaced between two steel plates 20 and 21 (2 mm and 6.4 mm thick, respectively). The sandwich-like element 16 is positioned at a typical standoff of 7 to 10 m in compliance with the UN regulations and is inclined horizontally at about 30°. The following Table 1 represents bullet impact sensitivity test results at room temperature for different explosives applied in such a sandwich-like assembly.

TABLE 1 bullet impact sensitivity tests

| Explosive | Burning probability | Burning duration |
|---|---|---|
| C-4 | High (10/10) | >10 min. |
| LF-2 | Low (4/10) | 5-10 min. |
| LBR-6 | Low (4/10) | 1-2 min. |

The term burning probability denotes the likelihood of ignition of the explosive in the sandwich-like element 16 upon striking by a 14.5 mm round. The data presented in Table 1, under "burning probability" indicates the number of burning incidents out of 10 rounds fired. The term burning duration denotes the burning time of the 8 mm explosive layer in the sandwich-like element 16 once ignited upon striking by a 14.5 mm round.

In case of striking element 16 by smaller arms, such as 0.5" rounds, the burning probability of LF-2 and LBR-6 becomes zero (0/10), while for C-4 it is higher (4/10).

Turning now to FIGS. 3 to 5 there are illustrated photographs of several safety test setups and their respective results, according to the UN regulations.

Figure 3A:
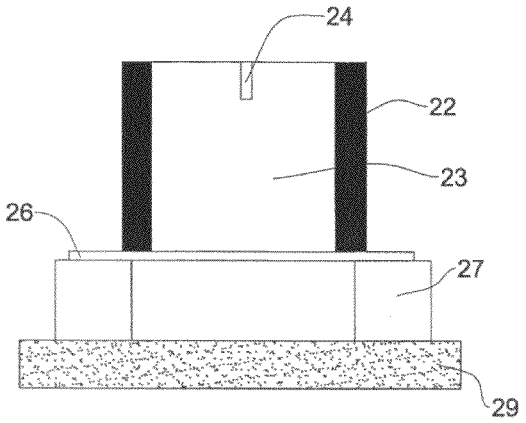
FIGS. 3A and 3B are setup and result of a cap sensitivity test (test 5(*a*))
Figure 3B:
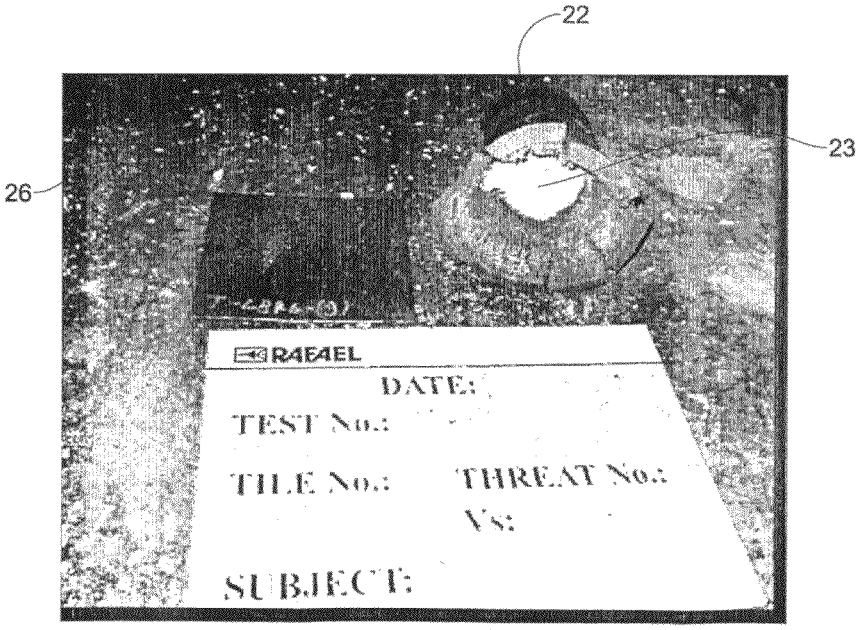

FIG. 3A is the setup of cap-sensitivity test (standard UN regulations (test 5(*a*)) showing a polyurethane cylinder 22 of standard dimensions containing LBR-6 explosive 23 with a No. 8 detonator 24 received there within in the center. The cylinder is positioned on a steel witness plate 26 placed over supports 27 which in turn rest on a heavy steel plate (40 mm thick) 29. A successful test result for a cap-sensitivity test is no penetration of the witness plate 26, as can be seen in FIG. 3B after ignition of the detonator 24. As can further be seen in FIG. 3B the explosive composition 23 is only mechanically scattered (i.e. no detonation occurred) such that most of the explosive remains intact in the cylinder. The other part of the cylinder was found outside of the cylinder after the test. Even more so the witness plate 26, shown on the left side of the picture, remains un-indented. The cylinder 22 is partially ripped owing to the detonation of the No. 8 detonator 24. The above results were repeated using a steel cylinder instead of polyurethane cylinder, considered as confined conditions which are much more severe (not shown).

Figure 4A:
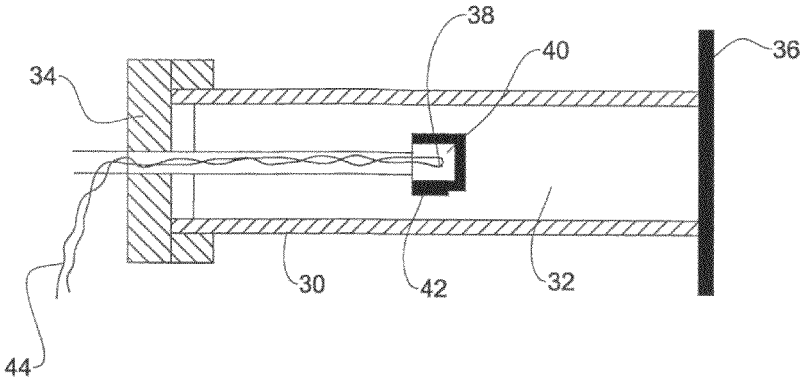
FIGS. 4A to 4B are setup and result of deflagration-to-detonation transition (DDT) test (test 5(*b*))

FIG. 4A illustrates a deflagration-to-detonation transition (DDT) test setup (standard UN regulations (test 5(*b*)), wherein a steel cylinder 30 is filled with the tested LBR-6 explosive 32. The bottom end of the cylinder 30 is welded to a steel whiteness plate 36. A detonator 38 is received within 5 grams of black powder 40 supported by a plastic container 42 within the tested explosive composition, with an electric cord 44 extending from the detonator 38 through a sealing cap 34 screwed coupled to seal an opposed end of cylinder 30.

Figure 4B:
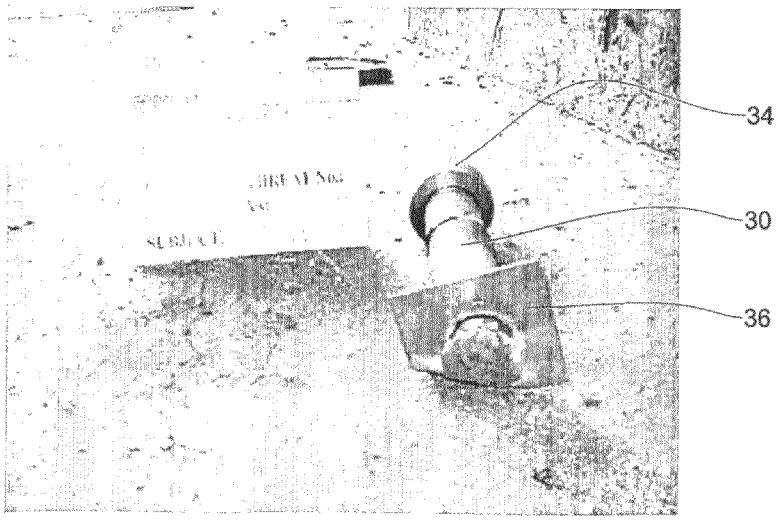

A successful test result for a DDT test is no penetration of the witness plate 36 due to detonation of the explosive 32. As can be seen in FIG. 4B the witness plate 36 is sheered due to pressure built up in the cylinder 30 but no penetration occurred as result of detonation. Moreover, the cylinder 30 and the cap 34 remained whole (undamaged) and most of the explosive was found after the test, 50% remains intact in the cylinder and the rest of it was found beside the cylinder.

Figure 5A:
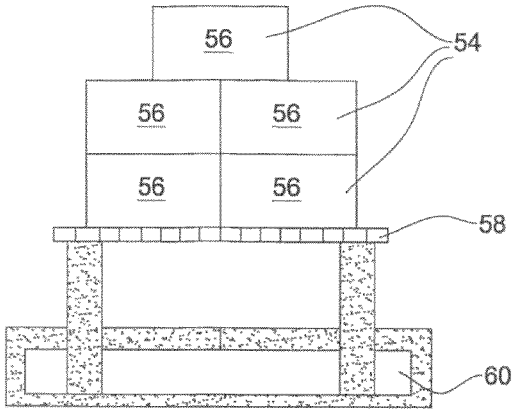
FIGS. 5A and 5B are setup and result of external fire test (test 6(*c*))

FIG. 5A illustrates an external fire test setup (standard UN regulations (test 6(*c*)) wherein five cardboard boxes 54 filled with 150 Kgs. of the tested LBR-6 explosive 56 (a total volume of 0.15 $m^3$ in compliance with the UN regulations) are mounted on a rack 58 placed in a Kerosene reservoir 60 of 1500 liters. The Kerosene is remotely ignited resulting in a total burning of the boxes 54 containing the explosive composition 56.

Figure 5B:
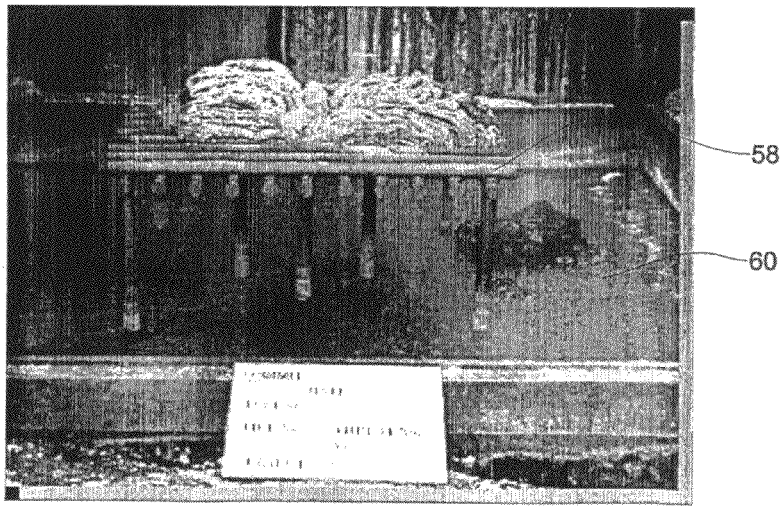

As is illustrated in FIG. 5B after complete burning of the explosive composition during 1 hour, remainders of the explosive composition 56 are visible. These results indicate a low burning rate of the LBR-6 explosive. Furthermore, in such a test the burning of the LBR-6 explosive was non-violent (calm), i.e. throwing flames at a diameter of approx. 30 cm. in average.

The safety test results obtained in the tests exemplified in FIGS. 3 to 5 indicate an explosive composition qualifying as a Class 1.5D according to UN regulations for the transport of dangerous goods.

The composition obtained according to the present invention may be used, according to one of its applications, as an explosive composition in an explosive reactive armor (ERA) module, applied on combat vehicles etc.

Whilst some particular embodiments have been illustrated and described, it will be appreciated by persons skilled in the art that the present invention is not limited by what has been particularly shown by the exemplary embodiments described hereinabove. Thus, it should be understood that numerous additional embodiments are within the scope of the invention, mutatis mutandis.

The invention claimed is:

1. An explosive composition, comprising:

an explosive material comprising cyclotrimethylene trinitramine (RDX or reduced sensitivity RDX);

a fire retardant comprising alumina-trihydrate (ATH); and a binder composition comprising polydimethylsiloxanes (PDMS), wherein the explosive composition is not cap-sensitive.

2. The explosive composition according to claim 1, wherein the fire retardant consists of ATH.

3. The explosive composition according to claim 1, wherein the binder composition consists of PDMS.

4. The explosive composition according to claim 3, wherein PDMS is present in an amount of 24% or 25%.

5. The explosive composition according to claim 1, further comprising a taggent.

6. The explosive composition according to claim 5, wherein the taggent is present in an amount of up to 0.18% vol.

7. The explosive composition according to claim 1, further comprising a pigment agent.

8. The explosive composition according to claim 7, wherein the pigment agent is present in an amount of up to 0.05% vol.

9. The explosive composition according to claim 1, the fire retardant consists of ATH, the binder consists of PDMS, and the explosive composition optionally further comprises a pigment agent and/or a taggent agent.

10. The explosive composition according to claim 5, wherein the taggent agent is selected from the group consisting of ethylene glycol dinitrate (EGDN), 2,3-Dimethyl-2,3-dinitrobutane (DMDNB), para-Mononitrotoluene (p-MNT), and ortho-Mononitrotoluene (o-MNT).

11. The explosive composition according to claim 10, wherein the taggent agent is DMDNB.

12. The explosive composition according to claim 1, further comprising one or more additional agent selected from the group consisting of a coloring agent, a pot-life extender, a cross-linking agent and a catalyst.

13. The explosive composition according to claim 1, wherein the explosive material is present in an amount of from 42 to 58% vol.

14. The explosive composition according to claim 1, wherein the fire retardant is present in an amount of 15 to 26% vol.

15. The explosive composition according to claim 1, wherein the binder composition is present in an amount of from 20 to 36% vol.

16. The explosive composition according to claim 15, wherein the PDMS is present in the binder composition in an amount of from about 88% to 95%.

17. An explosive composition, comprising:

an explosive material comprising cyclotrimethylene trinitramine (RDX or reduced sensitivity RDX) and cyclotetramethylene tetranitramine (HMX or reduced sensitivity HMX), the explosive material being present in an amount of in an amount of from 42 to 58% vol.;

a fire retardant comprising boric acid, the fire retardant being present in an amount of 15 to 26% vol.;

a binder composition comprising polydimethylsiloxanes (PDMS), the binder composition being present in an amount of from 20 to 36% vol., wherein the explosive composition is not cap-sensitive.

18. The explosive composition according to claim 17, wherein the fire retardant consists of boric acid.

19. The explosive composition according to claim 18, wherein the boric acid is present in an amount of 22% or 25%.

20. The explosive composition according to claim 17, wherein the binder composition consists of PDMS.

21. The explosive composition according to claim 20, wherein PDMS is present in an amount of 24% or 25%.

22. The explosive composition according to claim 17, further comprising a taggent present in an amount of up to 0.2% vol.

23. The explosive composition according to claim 17, further comprising a pigment agent.

24. The explosive composition according to claim 23, wherein the pigment agent is present in an amount of up to 0.05% vol.

25. The explosive composition according to claim 17, wherein the explosive material consists of RDX and HMX, the fire retardant consists of boric acid, the binder consists of PDMS, and the explosive composition optionally further comprises a pigment agent.

26. The explosive composition according to claim 17, herein the explosive material consists of RDX and HMX, the fire retardant consists of boric acid, and the explosive composition optionally further comprises a taggent agent and/or a pigment agent.

27. The explosive composition according to claim 26, wherein the boric acid is present in an amount of 25% vol., the PDMS is present in an amount of 25% vol., the taggent agent is present in an amount of up to 0.2% vol. and the pigment agent is present in an amount up to 0.05% vol.

28. The explosive composition according to claim 26, wherein the boric acid is present in an amount of 22% vol, the PDMS is present in an amount of 24% vol, the taggent agent is present in an amount of up to 0.18% vol and the pigment agent present in an amount up to 0.05% vol.

29. The explosive composition according to claim 22, wherein the taggent agent is selected from the group consisting of ethylene glycol dinitrate (EGDN), 2,3-Dimethyl-2,3-dinitrobutane (DMDNB), para-Mononitrotoluene (p-MNT), and ortho-Mononitrotoluene (o-MNT).

30. The explosive composition according to claim 29, wherein the taggent agent is DMDNB.

31. The explosive composition according to claim 17, further comprising one or more additional agent selected from the group consisting of at least one coloring agent, comprising one or more at least one pot-life extender, a cross-linking agent and a catalyst.

32. The explosive composition according to claim 17, wherein the PDMS is present in the binder composition in an amount of from about 88% to 95%.

* * * * *